US008476210B2

(12) United States Patent
Short

(10) Patent No.: US 8,476,210 B2
(45) Date of Patent: Jul. 2, 2013

(54) COMPOSITION FOR COMPRESSOR WORKING FLUID FOR APPLICATIONS WITH SOLUBLE GAS OR GAS CONDENSATES

(75) Inventor: Glenn Short, Wixom, MI (US)

(73) Assignees: Glenn Short, Commerce Township, MI (US); BVA, Inc., Wixom, MI (US)

( * ) Notice: Subject to any disclaimer, the term of this patent is extended or adjusted under 35 U.S.C. 154(b) by 29 days.

(21) Appl. No.: 12/556,245

(22) Filed: Sep. 9, 2009

(65) Prior Publication Data

US 2011/0059880 A1 Mar. 10, 2011

Related U.S. Application Data

(60) Provisional application No. 61/095,467, filed on Sep. 9, 2008.

(51) Int. Cl.
*C10M 169/04* (2006.01)
*C10L 1/16* (2006.01)

(52) U.S. Cl.
USPC ..... 508/591; 508/110

(58) Field of Classification Search
USPC ..... 208/19; 508/110, 591
See application file for complete search history.

(56) References Cited

U.S. PATENT DOCUMENTS

| | | | | |
|---|---|---|---|---|
| 4,111,821 | A | 9/1978 | Lazarus et al. | |
| 4,248,726 | A * | 2/1981 | Uchinuma et al. | 508/304 |
| 6,267,907 | B1 | 7/2001 | Tolfa et al. | |
| 6,774,093 | B2 | 8/2004 | Carr et al. | |
| 7,303,693 | B2 | 12/2007 | Fahl et al. | |
| 2002/0098993 | A1 | 7/2002 | Ohsumi et al. | |
| 2003/0206808 | A1 * | 11/2003 | Walker | 417/53 |
| 2007/0000807 | A1 | 1/2007 | Wu et al. | |
| 2007/0289897 | A1 | 12/2007 | Carey et al. | |
| 2007/0298990 | A1 | 12/2007 | Carey et al. | |
| 2008/0020954 | A1 | 1/2008 | Haigh et al. | |
| 2008/0026970 | A1 | 1/2008 | Wright et al. | |
| 2008/0207475 | A1 * | 8/2008 | Haigh et al. | 508/463 |
| 2008/0214418 | A1 | 9/2008 | Psillas | |
| 2009/0062167 | A1 | 3/2009 | Kaneko | |

* cited by examiner

*Primary Examiner* — Prem C Singh
*Assistant Examiner* — Francis C Campanell
(74) *Attorney, Agent, or Firm* — Kohn & Associates PLLC

(57) ABSTRACT

A composition of compressor working fluid including a dissolved gas or a condensate from a dissolved gas, and a base fluid including at least a first base stock and a second base stock, wherein the viscosity difference between the first base stock and the second base stock is greater than 125 cSt, Kv 100° C. A composition of compressor working fluid including a dissolved gas or a condensate from a dissolved gas, and a base fluid including a first base stock and a second base stock, wherein the viscosity difference between the first and second base stock is greater than 40 cSt, Kv 100° C., and wherein the first and second base stocks are each polyglycol or polyalkylene glycol base derived from propylene oxide. A method of achieving favorable viscosity index for a compressor working fluid. A method of reducing dilution from gas being compressed for a compressor working fluid.

21 Claims, 5 Drawing Sheets

Figure 1: Viscosity and Vapor Pressure
PA0 40 Base Stock with Propylene
A
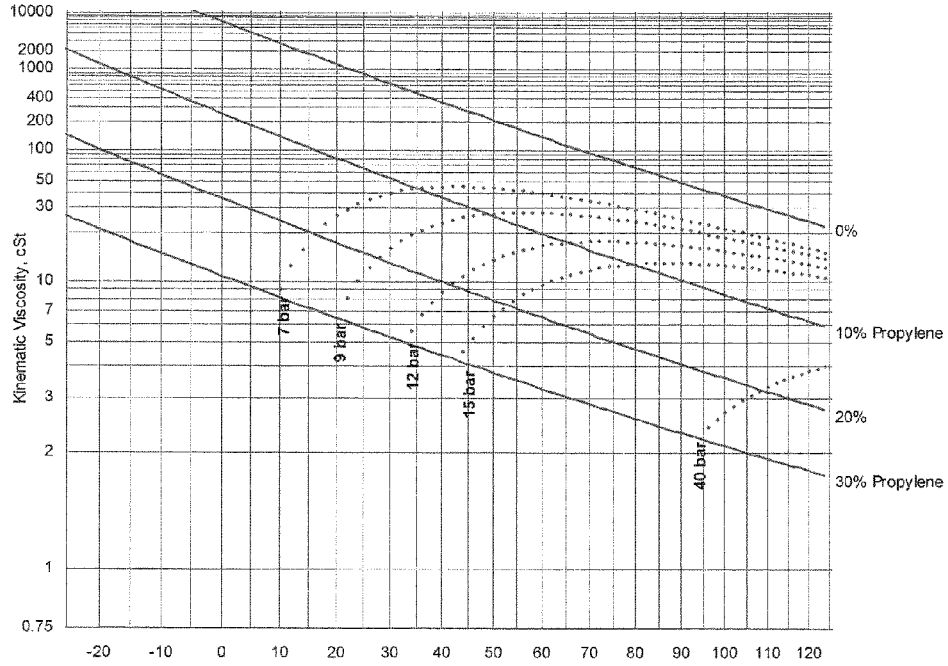
B
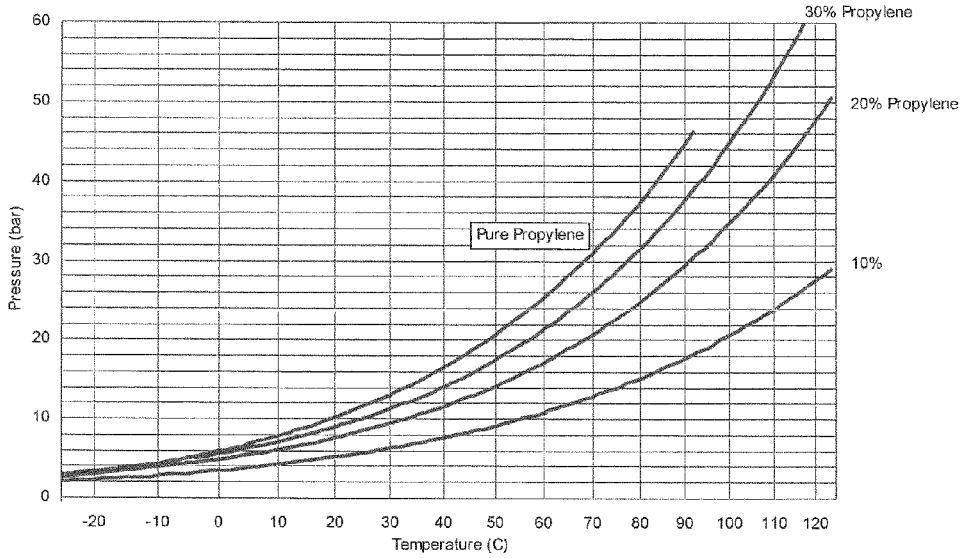

Green Data Set – Blend B
Red Data Set – Blend A
Figure 2: Viscosity and Vapor Pressure
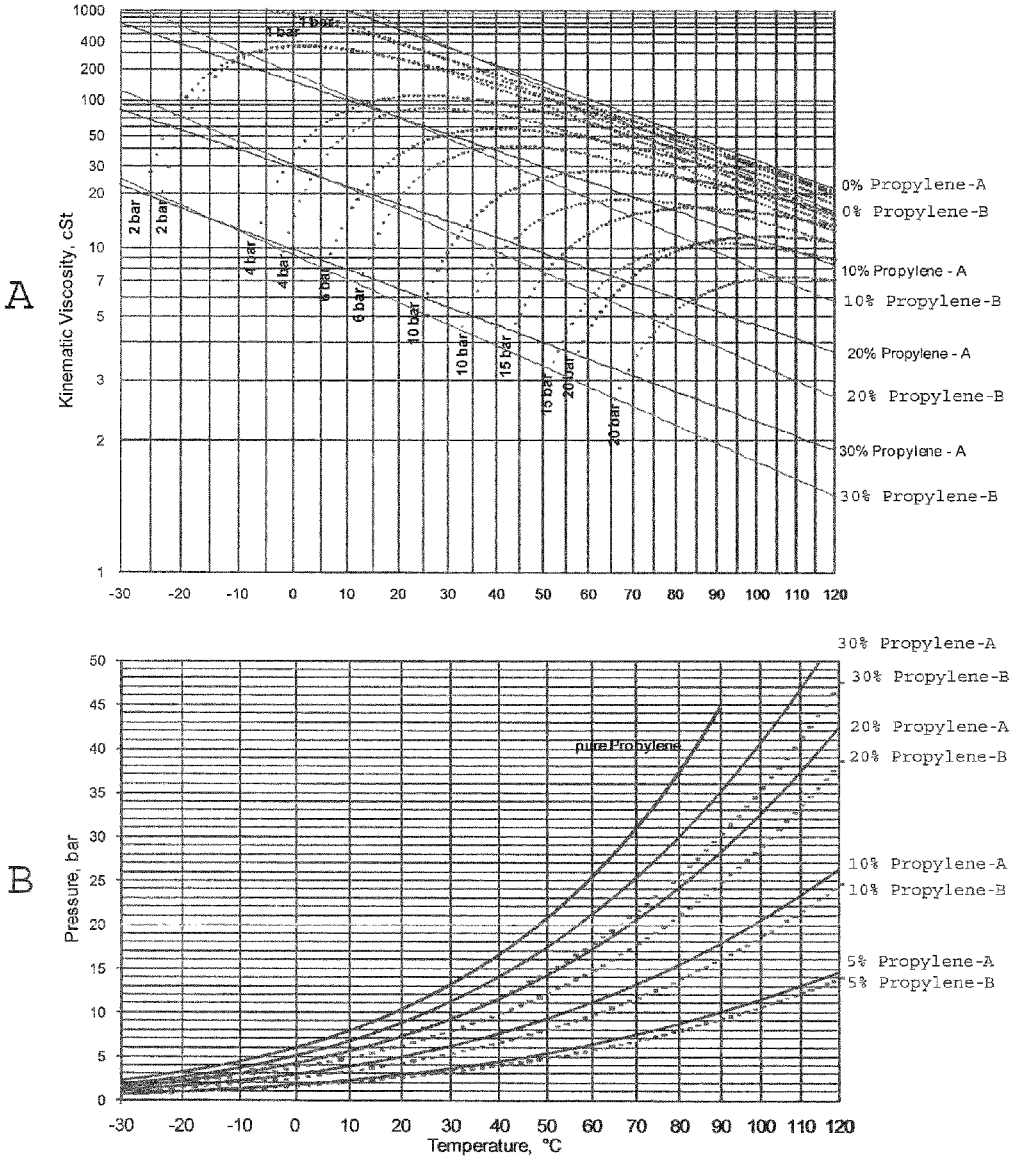

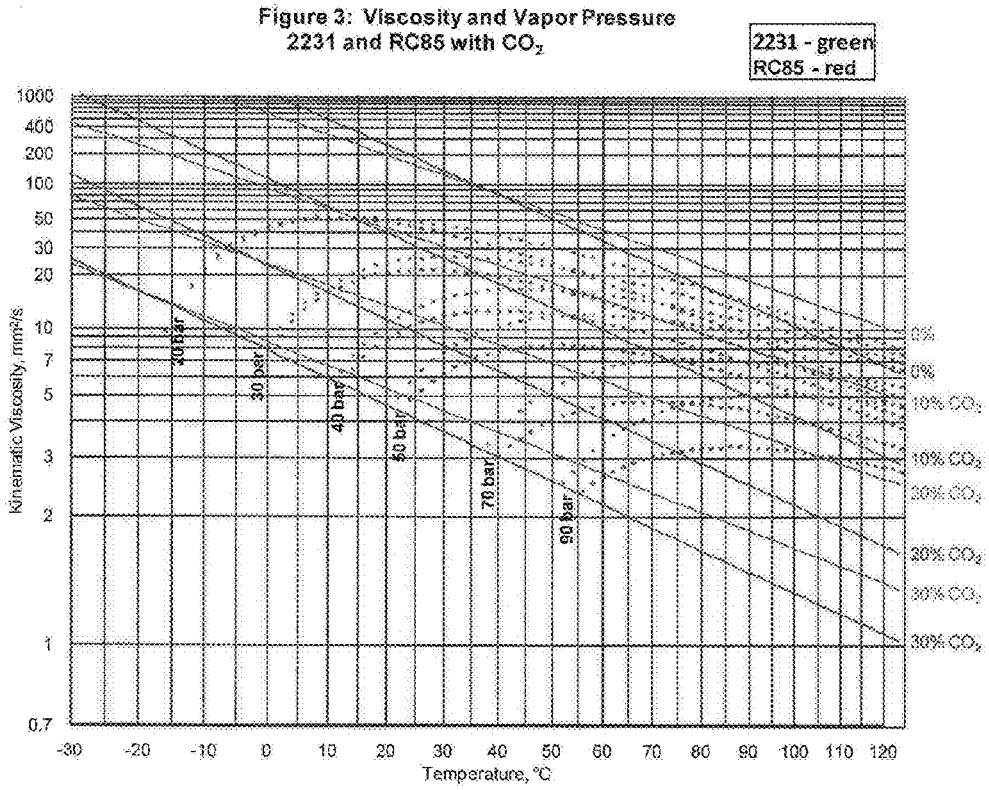
Figure 3: Viscosity and Vapor Pressure
2231 and RC85 with $CO_2$
2231 - green
RC85 - red
Kinematic Viscosity, mm²/s
1000
400
200
100
50
30
20
10
7
5
3
2
1
0.7
-30
-20
-10
0
10
20
30
40
50
60
70
80
90
100
110
120
Temperature, °C
20 bar
30 bar
40 bar
50 bar
70 bar
90 bar
0%
0%
10% $CO_2$
10% $CO_2$
30% $CO_2$
30% $CO_2$
30% $CO_2$
30% $CO_2$

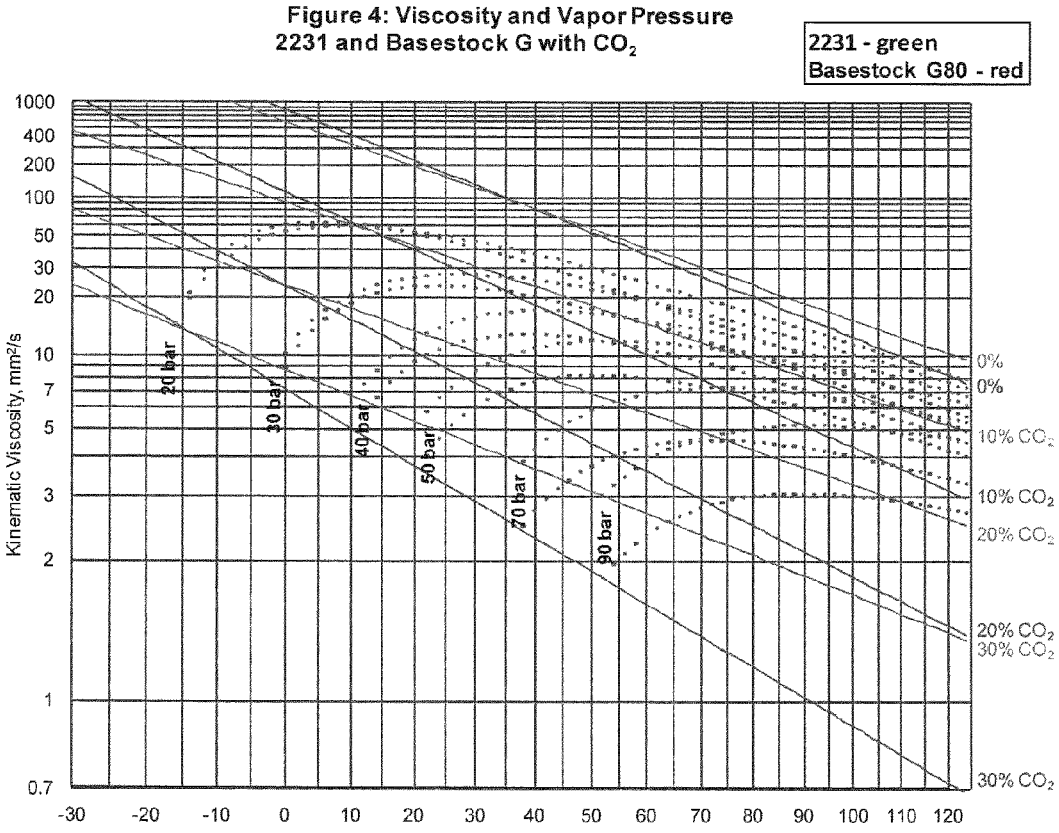
Figure 4: Viscosity and Vapor Pressure
2231 and Basestock G with $CO_2$
2231 - green
Basestock G80 - red
Kinematic Viscosity, mm²/s
1000
400
200
100
50
30
20
10
7
5
3
2
1
0.7
-30
-20
-10
0
10
20
30
40
50
60
70
80
90
100
110
120
20 bar
30 bar
40 bar
50 bar
70 bar
90 bar
0%
0%
10% $CO_2$
10% $CO_2$
20% $CO_2$
20% $CO_2$
30% $CO_2$
30% $CO_2$

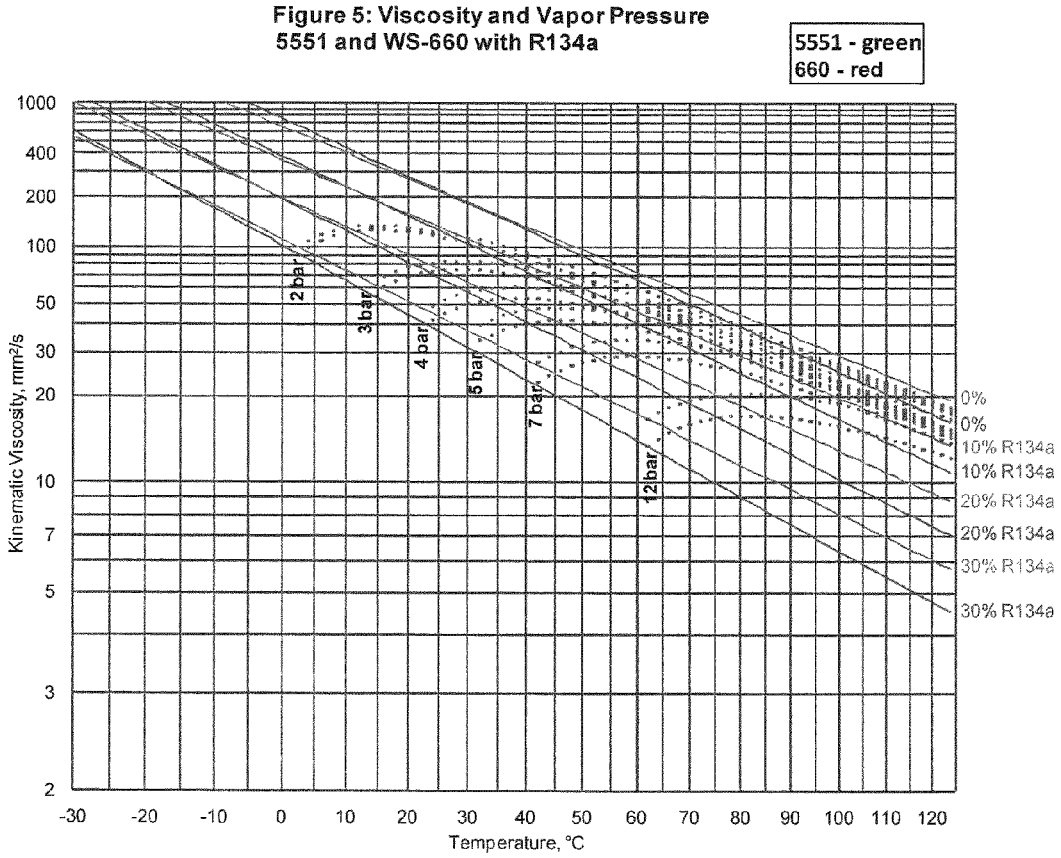
Figure 5: Viscosity and Vapor Pressure
5551 and WS-660 with R134a
5551 - green
660 - red
Kinematic Viscosity, mm²/s
1000
400
200
100
50
30
20
10
7
5
3
2
-30
-20
-10
0
10
20
30
40
50
60
70
80
90
100
110
120
Temperature, °C
2 bar
3 bar
4 bar
5 bar
7 bar
12 bar
0%
0%
10% R134a
10% R134a
20% R134a
20% R134a
30% R134a
30% R134a

COMPOSITION FOR COMPRESSOR WORKING FLUID FOR APPLICATIONS WITH SOLUBLE GAS OR GAS CONDENSATES

CROSS-REFERENCE TO RELATED APPLICATIONS

This application claims the benefit of priority under 35 U.S.C. Section 119(e) of U.S. Provisional Patent Application No. 61/095,467, filed Sep. 9, 2008, which is incorporated herein by reference.

BACKGROUND OF THE INVENTION (1) Field of the Invention

The present invention relates to lubricants for gas compressors.

(2) Description of Related Art

Mixtures of low viscosity lubricant base stock with high viscosity lubricant base stocks are often referred to in the art as "dumbbell" blending. The result is a blended base stock with a viscosity intermediate to the two base stocks. In some cases the result also includes an improvement in the viscosity index, also called VI, as described in ASTM D-2270, (ASTM International provides standards worldwide). The same results can be obtained if more than two base stocks are blended. In general, if a low viscosity index base stock is blended with a high viscosity index base stock, then the result obtained is normally a blend with a viscosity index higher than the low viscosity index base stock. If the low viscosity base stock and the high viscosity base stock each have the same viscosity index, the resulting viscosity index for the blend in general is equal to or greater than that viscosity index.

It is well known that blends of certain base stock types can result in a viscosity index greater than either of the original two base stock. Polyalphaolefins or PAOs are a type of synthetic hydrocarbon. They are generally classified by their viscosity in cSt at 100° C. as determined by ASTM D-445. For example a PAO 4 would have approximately a viscosity of 4 cSt at 10° C. and a PAO 40 would have approximately a viscosity of 40 cSt at 10° C. In one study, the viscosity index of a PAO 6 was a measured at 119 and the viscosity index of a PAO 40 was measured at 142. A mixture of approximately equal portions of the two PAO base stocks resulted in a viscosity index of 149.

Compressors used to compress gasses that can be soluble in the compressor fluid require the selection of a sealing and lubricating fluid that will result in a viscosity sufficient to seal the compression area and to provide the required lubrication to bearings, gears and other mechanical parts. Lubricants that are to be used in reciprocating gas compressors must provide lubrication for the crankshaft and other portions of the drive train and transmission parts of the compressor, and they must provide lubrication for the compression chamber. The lubrication of the drive train and transmission parts of the compressor requires an extremely stable material that retains its viscosity and lubricating properties under various extreme conditions. A second function is to help seal piston rings.

There are several types of reciprocating compressors. Lubrication points include cylinders, valves, pistons, piston rings, crankshafts, connecting rods, main and crank pin bearings, and other associated parts. Double-acting machines use crossheads and crosshead guides with connecting pins to join the crosshead to connecting rods. Most single-acting compressors use connecting rods attached directly to the pistons with wrist pins or piston pins. "Oil-free" machines do not require lubrication in the compression area.

Cylinder lubrication is applied to cylinder parts, pistons, rings, valves, and rod packings. Crankcase parts include main and crank pin, crosshead (or wrist pin) bearings, and crossheads and crosshead guides. Additionally, the lubricant may help the efficiency of seals and minimize their wear. The crankcase on a reciprocating compressor can either be open to the cylinder (as in many vertical, V-type, and radial compressors) or sealed from the cylinder by a bulkhead and exposed to air (horizontal compressors). Bearing and other crankcase components require relatively large amounts of lubricant, which is usually supplied from the crankcase. Supply methods include "splash" (utilizing dippers in the oil), "flooded" (devices to lift the oil such as disks, screws, grooves, or oil ring gears), and "forced-feed" systems.

Cylinder lubricant may be "splashed" from the crankcase or "force-fed" from either the crankcase or a separate reservoir. Ideally, the amount of lubricant used is the minimum needed to provide a strong lubricant film (to minimize wear and friction, to seal piston rings, valves, and rod packings), remove heat, and prevent corrosion.

A machine with the crankcase open to the cylinder can experience gas leaks past the oil control rings and into the oil. In systems in which the crankcase is not open to the cylinder (i.e., the oil is fed to the cylinder walls and piston rod packings with a force-feed lubrication system) essentially all the oil fed to the cylinder eventually leaves the compressor with the gas.

Screw compressors, or rotary screw compressors are constant volume devices having a built-in compression ratio. Compression in the single-stage, double-helical type occurs through the meshing of two rotors in a one-piece, dual-bore cylinder. The cylinder has gas inlet passages, oil injection, a compression area, and discharge ports. Rotors are designated as male, with helical lobes, and female, with corresponding helical grooves. In oil-flooded machines, the lubricant is injected into the compression area, affording sealing via an oil film between the intermeshing screws, and removal of the heat of compression. Oil separators are used to remove the oil from the discharge gas. "Dry screw" machines utilize timing gears to position the screws so that no internal lubrication is required.

Liquid-injected, single-screw compressors are constant volume, variable pressure machines. Compression results from the intermeshing of a single screw with one or two gate rotors. The screw and casing combine to act as a cylinder. The gate rotor or rotors act as a piston. The screw also provides the action of a rotary valve, the screw and gate act as a suction valve, and the screw and casing (port) serve as a discharge valve. There is a relatively low amount of friction between the screw and gate, as nearly all the compression is supplied by the screw. Bearings can be lubricated by grease or fluid, depending on design.

There are two common types of vane compressor: fixed and rotating. Both types provide positive-displacement, non-reversing compression. The fixed-vane type uses a ring or roller, which rotates around an eccentric shaft. A single vane is mounted in a non-rotating cylinder housing. The rotating-vane compressor has a rotor concentric with the shaft and off-center with respect to the cylinder housing. The rotor is equipped with radially sliding vanes, which are forced against the cylinder walls by centrifugal force. Gas is trapped between the vanes and wall, where a reduction in volume serves to compress it.

The lubricant in rotary vane compressors helps to provide a seal between the sliding vanes and the cylinder (or ring) wall. Larger systems may use oil pumps. Adequate lubrication should be provided to the vanes, vane slots, bearings, and seal faces. The oil to the cylinders may be supplied from the bearing lubricant discharge. The lubricant also prevents gas leakage in rotating shaft seals.

The basic compression unit in a scroll compressor is a set of two scrolls, one fixed and the other moving in a controlled orbit around a fixed point. Areas of lubrication include a short throw crank mechanism, bearings, and the scroll tip. Sealing is achieved through very accurate machining, proper balancing of pressures between scrolls, linkage mechanisms, and sometimes a sealing element at the tip of the involute.

The compressor working fluid in compressor applications which compress gasses which are soluble consists of the base stocks, additives, dissolved gasses and any condensate from those dissolved gasses or condensates of materials that are carried in with the feed gas. This working fluid is used to lubricate compressor mechanical parts, seal compression areas, seal other areas such as pumps and seal housings, and in some cases provide a method of removing the heat of compression. The working fluid in these compression systems influences the operation and efficiency of the entire system. Some of this fluid is carried out of the compressor and into the system. The interactions of the working fluid will impact the return of this fluid to the compressor. The solubility of the components from the gas being compressed in the working fluid, either as dissolved gas or gas condensates, impacts compressor performance. Dissolved gas in the working fluid's base stock(s) reduces the viscosity of the working fluid. Excessive dissolved gas can lead to wear and/or inefficient compression. The effect of the solubility of the gas on the ability of the working fluid to lubricate is a major concern. Excessive dilution may cause a reduction in viscosity resulting in a loss of the working fluid's film thickness. The lubricant can be washed off wear surfaces by liquid components of the gas. Additional problems can occur when there is a reduction of pressure, followed by degassing (foaming, cavitation, loss of lubricant film). A high degree of solubility of base stock components with the gas can result in loss of the base stock through absorption into the gas phase. This can result in high working fluid feed rates and a source of contamination to the gas leaving the compression system.

The working fluid has more effect on the performance of a screw compressor than is the case with a reciprocating compressor, primarily because of differences in the design of the two oil systems. The screw compressor injects the working fluid at discharge pressure into the compression chamber. This oil is then removed from the compressed gas by the use of an oil separator and sump situated on the high pressure side of the system. The screw compressor benefits from a working fluid derived from base stocks which exhibit limited solubility and a higher viscosity with the gas at discharge conditions (at the oil separator) to achieve high performance. Limited solubility will reduce or eliminate bypass of the gas being compressed from discharge to suction or to a lower situated thread. External bypass due to the gas circulating with the base stock is also reduced, leading to both high volumetric efficiency and low torque.

The lubrication and sealing of gas compressors encompasses many different types of gas, which can be categorized as inert, soluble, or reactive. The type of gas (hydrocarbon, carbon dioxide, etc.), the functionality of the base stocks used, and the performance of the compressor must all be considered. There are three distinct areas of concern in gas applications: solubility, reactivity, and the effect of the lubricant as a contaminant in the compressed gas. The first two affect the compressor performance and the latter the gas application. Under certain pressures and temperatures even so called "insoluble gasses" can have enough solubility to influence the viscosity or lubrication properties on the working fluid and so are included in the subject of this invention.

Reactions of the gas with the lubricant can result in premature failure of the compressor or, in more severe cases, fires and explosions. Base stocks or additives may react with or inhibit catalysts, cause mechanical problems in the application (valves etc.), or plug areas of gas flow.

The compression of soluble gasses often involves the selection of synthetic working fluids due to their unique viscosity-temperature relationships or for their resistance to dilution by the gas or its condensates. The major difference of compressor working fluids used in soluble gas applications from lubricants or fluids used with non-soluble gasses or in general those lubricants used in industrial lubrication is that the compressor working fluid in soluble gas applications consists of the base stocks used and the gas or gas condensates that may dissolve in the compressor working fluid. These dissolved gasses or gas condensates have an effect on the viscosity and viscosity temperature relationship of the compressor working fluid. Additives can also be used in the formulation of compressor working fluids used in the compression of soluble gasses. Certain types of base stocks have been found to reduce or eliminate the effects of these dissolved materials, but do not always provide the best overall choice for a working fluid. Additional factors such as potential reactions with catalysts used in process systems, low temperature fluidity, viscosity temperature characteristics, stability, wear characteristics or even cost can eliminate the potential use of certain types of base stocks.

Hydrocarbon gases are types of soluble gases that are encountered in the collection and transmission of natural gas, in vapor recovery, in landfill gas compression, in the petroleum and chemical industries. These "gasses" often are mixtures of hydrocarbon components, hydrogen, carbon monoxide, carbon dioxide, hydrogen sulfide and can include other chemical components used in the process. Certain types of base stocks are often selected for their resistance to dilution by hydrocarbons. These are often oxygen containing materials such as polyglycols or polyalkylene glycols and their derivatives. Other types of synthetic base stocks such as esters, ethers, silicones, and halogen containing fluids have also been used to reduce dilution.

Compressed natural gas and other hydrocarbon gases are used to fuel gas turbines. The compressor supplies the gas at the flow rate and pressure needed for continuous operation of the turbine. Petroleum-based lubricants carried in the gas may produce carbonaceous deposits in the gas inlet nozzles of the turbine, restricting flow and causing flameout.

Hydrocarbon gases are often the feedstock for a chemical process. Examples include ethylene and propylene used in the manufacture of polyethylene and polypropylene. Synthetic oils are often used for these applications because they do not react with or inhibit the catalysts. Additionally, synthetic lubricants can be used in the production and handling of ethylene and propylene as a result of the same concerns.

In reciprocating compressor applications, for pressures below 1000 psig, ISO Viscosity Grade 100-150 mineral oils can be used. Problems occur when the gas is wet or at increased pressures. The addition of fatty oils is common. These additives, which are difficult to pump at low temperatures, can cause damage to discharge valves, accumulate in aftercoolers and piping, and emulsify with water.

High pressure reciprocating compressors (5000 psig) are used to re-inject natural gas into crude. Four basic problems have been identified with this process: (1) loss of lubricant viscosity, (2) increased cylinder wear rate because lubricant was washed off surfaces by liquid components in the gas, (3) loss of lubricant to the high pressure gas stream, which results in feed rates to rod packings of 10 times normal rates, or up to a barrel of lubricant per day per compressor, and (4) reaction of additives with well-bore fluids, leading to permanent impairment to the well and reduced gas injection rates.

Viscosity is the most critical lubricant requirement that must be met in the hydrocarbon gas rotary screw compressors. Viscosity can be lowered as the lubricant is diluted by the hydrocarbon gas in the compressor and oil separator. The final level of dilution is determined by the temperature and pressure in the separator, which is located on the discharge side of the compressor. Synthetic lubricants offer the advantage of very high viscosity and, in some cases such as with polyalkylene glycols, are resistant to dilution (lower solubility with hydrocarbon gases).

Even though synthetic lubricants have improved the lubrication and efficiency of gas compressors, there is a need for improvement.

BRIEF SUMMARY OF THE INVENTION

The present invention provides for a composition of compressor working fluid including a dissolved gas or a condensate from a dissolved gas, and a base fluid including at least a first base stock and a second base stock, and the viscosity difference between the first base stock and the second base stock is greater than 125 cSt, Kv 100° C.

In one embodiment of the present invention the first and the second base stock are each synthetic polyalphaolefin.

The present invention also provides for the first and the second base stock to be selected from different types of base stocks. For example the low viscosity base stock may be a synthetic ester such as a diester or a polyol ester and the higher viscosity base stock may be a synthetic polyalphaolefin.

The present invention also provides for a composition of compressor working fluid including a dissolved gas or a condensate from a dissolved gas, and a base fluid including a first base stock and a second base stock, wherein the viscosity difference between the first base stock and the second base stock is greater than 40 cSt, Kv 100° C., and wherein the first and second base stocks are each polyglycol or polyalkylene glycol base derived from propylene oxide.

The present invention also provides for a composition of compressor working fluid including a dissolved gas or a condensate from a dissolved gas, and a base fluid including a first base stock and a second base stock, wherein the viscosity difference between the first base stock and the second base stock is greater than 40 cSt, Kv 100° C., and wherein the first and second base stocks are each polyglycol or polyalkylene glycol base derived from ethylene oxide and propylene oxide.

The present invention also provides for a composition of compressor working fluid including a dissolved gas or a condensate from a dissolved gas, and a base fluid including a first base stock and a second base stock, wherein the viscosity difference between the first base stock and the second base stock is greater than 40 cSt, Kv 100° C., and wherein the first and second base stocks are each esters. Preferably the viscosity difference between the first base stock and the second base stock is greater than 125 cSt, Kv 100° C. and preferably the higher viscosity ester is a polyol ester or a complex ester.

The present invention provides for a method of achieving favorable viscosity index and/or operating working viscosity for a compressor working fluid by combining a dissolved gas or a condensate from a dissolved gas with a base fluid including a first base stock and a second base stock, wherein the viscosity difference between the first and second base stock is greater than 125 cSt, Kv 100° C.

The present invention further provides for a method of reducing dilution from gas being compressed for a compressor working fluid by combining a dissolved gas or a condensate from a dissolved gas with a base fluid including a first base stock and a second base stock, wherein the viscosity difference between the first and second base stock is greater than 125 cSt, Kv 100° C.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein:

FIG. 1A is a graph of viscosity and FIG. 1B is a graph of the dilution at various temperatures and pressures of PAO 40 Base Stock with Propylene;

FIG. 2A is a graph of viscosity and FIG. 2B is a graph of vapor pressure the dilution at various temperatures and pressures for a PAO blend of the present invention and a normal PAO blend not of the present invention with Propylene;

FIG. 3 is a graph of viscosity, temperature, and pressure comparing Commercial Ester RC85 with Base Stock Blend 2231 of the present invention with Carbon Dioxide;

FIG. 4 is a graph of viscosity, pressure, and temperature comparing Base Stock Blend 2231 and Base Stock G with Carbon Dioxide; and FIG. 5 is a graph of viscosity, temperature, and pressure comprising Base Stock Blend 5551 and Base Stock WS 660 with R134a.

DETAILED DESCRIPTION OF THE INVENTION

The present invention is directed in general to methods of improving viscosity index of compressor working fluids and to a composition of compressor working fluid that includes a dissolved gas or a condensate from a dissolved gas, and a base fluid, that includes at least two base stocks. There is a viscosity difference between a first base stock and a second base stock. Preferably, this difference is greater than 125 cSt, Kv 100° C.

The base stocks can be, but are not limited to, GTL lubricants, wax derived lubricants, group II base stocks, group III base stocks, polyalphaolefin, polyalkylene glycol, polyglycol, ether base stock including polyvinlyether, polyglycol derivative base stock, ester base stock, alkylated aromatic, other Group IV lubricants, and Group V lubricants.

The first base stock can be a synthetic polyalphaolefin (PAO) with a viscosity less than 10 cSt and greater than 2 cSt, Kv 100° C.

Preferably when synthetic polyalphaolefin is the second base stock, the second base stock can be a synthetic polyalphaolefin with a viscosity greater than 295 cSt, Kv 100° C. The second base stock can also be a synthetic polyalphaolefin with a viscosity greater than 135 cSt, Kv 100° C. The second base stock can be a synthetic polyalphaolefin with a viscosity greater than 900 cSt, Kv 100° C.

One particular embodiment of the first and second base stock is the first base stock being a polyglycol or polyalkylene glycol with a viscosity less than 15 cSt and greater than 2 cSt, Kv 100° C. and the second base stock being a polyglycol or polyalkylene glycol with a viscosity greater than 135 cSt, Kv 100° C.

One particular embodiment of the first and second base stock is the first base stock being an ester with a viscosity less than 15 cSt and greater than 2 cSt, Kv 100° C. and the second base stock being a ester with a viscosity greater than 135 cSt, Kv 100° C. The esters may be of any type used as lubricants.

One particular embodiment of the first and second base stock is the first base stock being a polyol ester with a viscosity less than 15 cSt and greater than 2 cSt, Kv 100° C. and the second base stock being a polyol ester or complex ester with a viscosity greater than 135 cSt, Kv 100° C.

The composition can include a third base stock. Preferably, the third base stock is a PAO with a viscosity of at least 4 cSt, Kv 100° C. and no more than 100 cSt, Kv 100° C., ester base stock, alkylated aromatic, and combinations thereof.

The composition can also include a fourth base stock. When there are four base stocks, in one embodiment any combination of two or more of the base stocks results in a first blended base stock and a second blended base stock with the viscosity difference between the first blended base stock and the second blended base stock is greater than 135 cSt, Kv 100° C.

Preferably, the viscosity index of the composition is greater than 200. Preferably, the difference in number average molecular weight between the first and the second base stocks is greater than 2900. More preferably, the difference in number average molecular weight between said first and said second base stocks is greater than 3900. When the composition is the first base stock being a polyglycol or polyalkylene glycol with a viscosity less than 15 cSt and greater than 2 cSt, Kv 100° C. and the second base stock being a polyglycol or polyalkylene glycol with a viscosity greater than 135 cSt, Kv 100° C., preferably, the difference in number average molecular weight between the first and the second base stocks is greater than 1400. More preferably, the difference in number average molecular weight between the first and the second base stocks is greater than 2300. For ester based stock, the low viscosity is preferably less than 5 cSt at 100° C. and the high is preferably greater than 60 cSt at 100° C. The difference in the average molecular weight between the first and second base stock is greater than 1400, and preferably greater than 2000.

Especially advantageous results are obtained when the lubricant compositions of this invention are used in compressors that compress one or more of the following gases (i.e. the dissolved gas or condensate from the dissolved gas): saturated and unsaturated hydrocarbons having 1 to 26 carbon atoms, methanol, combustion gases, nitrogen, chlorine, methyl chloride, vinyl chloride, ammonia, hydrogen sulfide, carbon monoxide, carbon dioxide, carbon monoxide, halocarbons, hydrofluorocarbons, fluorochlorohydrocarbons, and other fluorine refrigerants such as 2,3,3,3-Tetrafluoroprop-1-ene and the like. In some operating conditions, the gas can also contain lighter molecular weight components such as hydrogen or helium. The gas can also contain small amounts of air, oxygen or water vapor.

The composition can also include at least one additive, such as, but not limited to, antiwear, antioxidant, defoamant, demulsifier, detergent, dispersant, metal passivator, friction reducer, rust inhibitor, acid scavenger, free radical scavenger, pH modifier, viscosity modifier, pour point additive, and combinations thereof.

In another embodiment, a composition is provided of compressor working fluid including a dissolved gas or a condensate from a dissolved gas, and a base fluid including a first base stock and a second base stock, wherein the viscosity difference between the first base stock and the second base stock is greater than 40 cSt, Kv 100° C., wherein the first and second base stocks are each polyglycol or polyalkylene glycol base derived from propylene oxide. This composition can also include additives as described above.

In another embodiment, a composition is provided of compressor working fluid including a dissolved gas or a condensate from a dissolved gas, and a base fluid including a first base stock and a second base stock, wherein the viscosity difference between the first base stock and the second base stock is greater than 40 cSt, Kv 100° C., wherein the first and second base stocks are each polyglycol or polyalkylene glycol base derived from propylene oxide and ethylene oxide. This composition can also include additives as described above.

In another embodiment, a composition is provided of compressor working fluid including a dissolved gas or a condensate from a dissolved gas, and a base fluid including a first base stock and a second base stock, wherein the viscosity difference between the first base stock and the second base stock is greater than 40 cSt, Kv 100° C., wherein the first and second base stocks are each polyglycol or polyalkylene glycol base derived from propylene oxide and ethylene oxide. This composition can also include additives as described above.

In another embodiment, a composition is provided of compressor working fluid including a dissolved gas or a condensate from a dissolved gas, and a base fluid including a first base stock and a second base stock, wherein the viscosity difference between the first base stock and the second base stock is greater than 40 cSt, Kv 100° C., wherein the first and second base stocks are each selected from polyglycol or polyalkylene glycol, esters and alkylated aromatic base stocks This composition can also include additives as described above.

The present invention provides for a method of achieving favorable viscosity index for a compressor working fluid by combining a dissolved gas or a condensate from a dissolved gas with a base fluid including a first base stock and a second base stock with the viscosity difference between the first and second base stock is greater than 125 cSt, Kv 100° C. The base stocks can be as described above, and a third and fourth base stock can also be added. Also, the additives described above can be added to the composition. The gas can also be as described above.

The present invention also provides for a method of reducing dilution, or the effect of dilution on viscosity, from the gas being compressed for a compressor working fluid by combining a dissolved gas or a condensate from a dissolved gas with a base fluid including a first base stock and a second base stock, wherein the viscosity difference between the first and second base stock is greater than 125 cSt, Kv 100° C. The base stocks can be as described above, and a third and fourth base stock can also be added. Also, the additives described above can be added to the composition. The gas can also be as described above.

The invention is further described in detail by reference to the following experimental examples. These examples are provided for the purpose of illustration only, and are not intended to be limiting unless otherwise specified. Thus, the present invention should in no way be construed as being limited to the following examples, but rather, be construed to encompass any and all variations which become evident as a result of the teaching provided herein.

EXAMPLE 1

One example is the case of rotary screw compressors used to transport propylene. The production of propylene in this example uses a catalyst that was found to react with oxygen containing lubricants such as polyalkylene glycols or ester lubricants. A synthetic hydrocarbon lubricant based on polyalphaolefin was found to be compatible with the catalyst; however, it has a higher degree of solubility with propylene than the oxygen containing lubricants. It was desirable to operate the compressor with a discharge operating temperature that resulted in about 10% by weight dilution from the propylene to maximize the efficiency of the compressor. The required viscosity of the working fluid, the base stock(s) with the dilution from the propylene, was approximately 30 cSt at 50° C. The result was that a conventional type of polyalphaolefin such as the PAO 40 shown in Table 1 with a viscosity of 396 cSt at 40° C. and 39.5 cSt at 100° C. was required. FIGS. 1A and 1B show the standard viscosity temperature pressure, also called V-P-T, chart for the PAO 40 type base stock with propylene (propene). For example, the PAO 40 base stock with propylene will result in about 10% dilution when operated a 20 bar pressure and 100° C. discharge temperature as indicated by using the chart in FIG. 1B. The resulting viscosity at 50° C. is found on the chart in FIG. 1A and is determined to be approximately 27 cSt, which is slightly lower than the desired operating viscosity for the working fluid (Base stock with propylene).

The synthetic hydrocarbon was required to maintain the minimum viscosity when diluted with the propylene (propene) to lubricate and seal the compressor. This created a new problem as the higher viscosity grade lubricant using the PAO 40 base stock as the viscosity was found to be too high for normal compressor start up at 15° C. or lower ambient conditions without the propylene dilution. The pure PAO 40 base stock was found to have a viscosity of over 1800 cSt.

TABLE 1

Weight percent of ISO Viscosity Grade 220 PAO Base Stock blends

| | Base Stock Blend A % wt | Base Stock Blend B % wt | Typical Properties Viscosity cSt at 100° C. | Typical Properties Molecular weight |
|---|---|---|---|---|
| PAO 6 | 57.27 | | 5.8 | 641 |
| PAO 10 | | 30.66 | 10 | 720 |
| PAO 40 | | 69.34 | 39.4 | 1680 |
| PAO 300 | 42.73 | | 300 | 4900 |
| Molecular Weight Average (1) | 2461 | 1386 | | |
| Viscosity cSt @40° C. | 215 | 204 | | |

(1) Molecular weight average was calculated by weight percent.

Using data for blends of conventional PAO base stocks, it was found that an ISO Viscosity Grade 220 would be required to meet the requirements of a maximum base stock viscosity of 1000 cSt at 15° C. The ISO Viscosity Grade 220 allows for a plus or minus of 10% resulting in a range of 200 to 240 cSt. It was determined that a blend of approximately 205 cSt at 40° C. would result in a viscosity below 1000 cSt at 15° C. FIG. 2A indicates the measured viscosity plot for this base stock Blend B at various temperatures at indicated in the 0% propylene (propene) curve. A blend of the invention is represented as Base Stock Blend A and the measured viscosity of this base stock at various temperatures is indicated in FIG. 2A in the 0% propylene curve. It was found that Base Stock A resulted in a viscosity nearly 150 cSt lower at 15° C. than a conventional PAO blend such as Base Stock B which would allow for easier flow or pumping of the fluid at start up conditions.

FIG. 2B also shows the results of laboratory tests as various temperatures and pressure of two Polyalphaolefin types of synthetic hydrocarbon blended base stocks combined with propylene as used as the compressor working fluid. The results of the tests found that the blend according to the invention provided a higher operating viscosity and a lower degree of solubility of the propylene by weight.

The 10% propylene in the invention working fluid using Base Stock Blend A as the remaining 90% results in a viscosity of 30 cSt at 50° C. which is remarkably higher than the viscosity of the pure PAO 40 with an equal percentage of propylene. The conventional blend of Polyalphaolefins in Base Stock Blend B with 10% propylene results in a viscosity of about 25 cSt at 50° C. or approximately 17% lower than Base Stock Blend A.

FIGS. 2A and 2B also indicates that the dilution of propylene is lower in Base Stock Blend A than with Base Stock Blend B. This is in part due to the higher average molecular weight of the blend. For example the percent dilution at 20 Bar and 100° C. result in about 9.6% dilution by propylene in Base Stock Blend B, and about 8.2% dilution in Base Stock Blend A.

Lower dilution is desirable. For example, many rotary screw compressor manufactures require a minimum viscosity of 10 cSt for the working fluid supplying the bearings of the compressor. Often higher operating pressures are desirable for propylene production processes to increase production volumes. If the compressor discharge is set to 90° C. and the lubricant oil supply at 45° C., the working fluid using Base Stock Blend A allows a discharge pressure of up to about 27.5 Bar where the resulting dilution is about 20% propylene and 80% Base Stock Blend A. Using the same design temperatures, Base Stock Blend B only allows for about 18% dilution with propylene and 82% Base Stock B to maintain 10 cSt, The maximum allowable operating discharge pressure would be approximately 23 Bar.

Initially this result may appear to be related to the higher viscosity index of the Base Stock Blend A when compared to Base Stock Blend B. However if these same two fluids were cooled to 40° C. where they initially had the same viscosity when undiluted, the viscosity when equally diluted with propylene is significantly different for these fluid mixtures.

The same type of operational benefits are possible in compressor applications with the invention blends when using other types of synthetics fluids. For example polyalkylene glycols are often used with hydrocarbon gasses, vinyl chloride, ammonia, CO2 and other gasses that exhibit solubility in the base fluids, particularly at higher pressures. The inclusion of oxygen in their structure generally makes them less soluble than hydrocarbon base stock with common hydrocarbon gasses such as methane, ethane, propane and butane. However, they generally have more solubility with other common gasses and certain aromatic materials such as alcohols, benzene, toluene and xylene that maybe be found in small percentages in refinery or process gas streams.

EXAMPLE 2

The Base stocks described in Table 2 are commonly described as polyalkylene glycols, which are alcohol-started polymers containing equal amounts by weight of oxyethylene and oxypropylene groups and chemically described as oxirane, methyl-, polymer with oxirane, monobutylether and are sold by BASF under the Trade Names of PLURACOL® or PLURIOL WS® Series. A similar series of products are sold by the Dow Chemical Corporation under the trade name of UCON 50-HB Fluids. These types of fluids are less soluble with normal hydrocarbons than alcohol started polymers of all oxypropylene groups such as the BASF PLURIOL WI® series or the Dow UCON LB® series. The increased amount of oxyethylene content increases the solubility with gasses such as ammonia.

TABLE 2

| | Base Stock Blend C % wt | Base Stock Blend D % wt | Base Stock Blend 5551 | Typical Properties Viscosity cSt at 100° C. | Typical Properties Molecular weight |
|---|---|---|---|---|---|
| WS-55 | | | 50 | 2.36 | 270 |
| WS-170 | 74 | | | 7.45 | 750 |
| WS-260 | | 70.7 | | 11.1 | 970 |
| WS-660 | | 29.3 | | 25.6 | 1590 |
| WS-5100 | 26 | | 50 | 164 | 3930 |
| Molecular Weight Average (1) | 1577 | 1152 | 2100 | | |
| Viscosity cSt @40° C. | 68 | 68 | 130.2 | | |
| Viscosity cSt @100° C. | 14.5 | 13.9 | 29.06 | | |

(1) Molecular weight average was calculated by weight percent.

In this example, the resulting viscosity temperature relationship was only slightly favorable for Base Stock C over Base Stock Blend D. This is likely due to the lower viscosity index of the WS 170 when compared to WS 260 or WS 660. However, the Molecular Weight average for Base Stock Blend C was over 35% higher than for Base Stock Blend C. Initial tests with ammonia as the gas component indicated that Base Stock C showed a lower tendency for entrainment and foaming with the ammonia. Tests were carried out with the ASTM D-892 apparatus at 70° C. but modified to use ammonia rather than air as the gas. It was noted than the level of increase in the volume of the Base Stock Blend C was less than that of the volume of the Base Stock D, which is an indication of lower solubility of the gas.

Referring further to FIG. 5, and Table 2, the Base Stock Blend 5551 was compared to WS-660 in pressure viscosity temperature tests with R-134a as the soluble gas. The WS-660 and the 5551 had approximately equal viscosity at 40° C. when compared before dilution. The 5551 consistently showed higher viscosity when diluted with the same amount of R134a. For example, when diluted by 30% R-134a at 40° C. the 5551 resulted in a viscosity greater than 28 cSt where the WS-660 resulted in a viscosity at about 22 to 23 cSt.

The solubility of the two products was examined. At lower pressures the two products were essentially the same. For example at 10 Bars and 100° C., the 5551 had about 9.9% dilution where the WS-660 resulted in about 9.8% dilution. However the viscosity at this temperature was higher for the 5551 at 8 cSt, compared to the WS-660 at about 6.4 cSt.

The solubility of the 5551 was found to be higher than the WS-660 at higher pressures. For example, at 28 Bars and 100° C., the 5551 resulted in about 33% dilution where the WS 660 was about 30% dilution. However the viscosity of the 5551 was about 10% higher at 7 cSt compared to 6.3 cSt for the WS-660.

Initially this result may appear to be related to the higher viscosity index of the 5551 when compared to the WS-660. However if these same two fluids were cooled to 40° C. where they initially had the same viscosity when undiluted, the diluted viscosity is significantly different for these fluid mixtures. At 0° C., typical for certain air conditioning evaporators, this mixture results in a viscosity of about 20% lower for the 5551 than the WS-660.

In view of the above, the inventive blends have a higher viscosity at 40° C. with gas dilution of 5%, 10%, etc., even though comparison oils at 0% dilution are equal.

The result is that the inventive fluid provides higher viscosities at the higher temperatures most often found in the compression area and thus improved sealing. The inventive fluid provides equivalent or higher viscosity at typical lubrication temperatures for improved lubricity. And the inventive lubricant provided lower viscosity at lower temperatures for improved fluidity at lower temperatures. These results would be optimal for air conditioning and refrigeration systems.

EXAMPLE 3

The use of Polyol Esters for compression of carbon dioxide, a so-called natural refrigerant, is being investigated by the refrigeration and air conditioning industry. Higher viscosity lubricants are desirable for small screw diameter rotary screw compressors with resulting lower male rotor tip speed—particularly where the tip speed is lower than 30 m/s. Tests using high viscosity complex esters with other refrigerants such as R-22 have proven to result in higher operating efficiencies when the working fluid has a high viscosity in the compression chamber. Improvements included increases in volumetric and adiabatic efficiency, and compressor capacity.

The applications call for demands of suitable screw compressor lubricants, mainly due to requirements for small oil separators, short dwell time in oil sump, good oil return characteristics, no or limited external oil cooling, high discharge temperature.

Carbon dioxide applications may also benefit screw compressor efficiency through the use of higher viscosity compressor working fluids. Polyol esters have been found to have enough solubility with carbon dioxide to provide the return of the compressor working fluid from the low temperature side of the refrigeration system. Due to the nature of carbon dioxide, the lubricant can require improved low temperature viscosity than the high viscosity complex esters used previously for applications with R-22. This is primarily because R-22 is highly miscible and easily acts as a solvent with ester type lubricants resulting in their combination flowing easily through evaporators.

Early tests with more conventional types of polyol esters have resulted in excessive wear to mechanical parts such as bearings. A thicker oil film improves lubrication.

Base Stock G has been described as a "Poly PE" type of Polyol ester with a weight average molecular weight of about 1100. See U.S. Pat. No. 6,774,093 B2 to Carr, et al., Issued Aug. 10, 2004. Base Stock G has been recommended for CO2 refrigeration applications including so-called "Transcritical" and has been found to have suitable low temperature viscosity characteristics for these applications. Base Stock RC85 is a commercial polyol ester sold for CO2 applications with a weight average molecular weight of about 640 to 710. Base Stock Blend 2231 is a blend of two polyol ester base stocks; a TMP type polyol ester with a weight average molecular weight of 470 combined with the higher molecular weight (2600).

One benefit resulting from the blend of the components is superior viscosity temperature characteristics compared Base Stock G. A comparison of measured pressure-temperature-viscosity (PVT) data for Base Stock G and the measured values of invention Base Stock Blend 2231 was made using CO2 as the soluble gas, as shown in FIG. 4. Base Stock Blend 2231 consistently resulted in a higher viscosity, even at 40° C. where the two base stocks have nearly identical initial viscosities before dilution. It is noted that at higher gas pressures and temperatures Base Stock G appeared to have less dilution while at lower pressures the dilution was nearly the same for the two Base Stocks. However the resulting viscosity of the Base Stock 2231 was surprisingly superior.

A comparison of commercially available pressure-temperature-viscosity (PVT) data for Base Stock RC85 and the measured values of invention Base Stock Blend 2231 was made using CO2 as the soluble gas, as shown in FIG. 3. Base Stock Blend 2231 consistently resulted in a higher viscosity, even at 40° C. where the two base stocks have nearly identical initial viscosities before dilution. It is noted that at higher gas pressures and temperatures the RC85 appeared to have less dilution while at lower pressures the dilution was nearly the same for the two Base Stocks. However the resulting viscosity of the Base Stock 2231 was surprisingly superior.

Different types of base stocks can be blended to achieve similar results to those described. A higher viscosity polyalkylene glycol base stock can be blended with a lower viscosity ester base stock. Either of these blends exhibit lower solubility with hydrocarbon gasses and their condensate than can be expected with the ester component alone. When combined with the superior viscosity temperature properties the blend can be adjusted to achieve higher operating viscosity for the working fluid. In certain refrigeration systems, a blend of components can be required to improve miscibility of the Base Stock blend while maintaining sufficient viscosity for compression area sealing.

Additionally, a third or more base stocks can be added to the base stock blend. It is common to blend different types of synthetic lubricants to improve on properties such as lubricity, seal swell, pour point, solvency, cleanliness, thermal stability, chemical stability, oxidative stability, water separation, resistance to emulsion and other properties required for specific operating conditions or environments.

At least one additive can be included, such as, but not limited to, antiwear, antioxidant, defoamant, demulsifier, detergent, dispersant, metal passivator, friction reducer, rust inhibitor, acid scavenger, free radical scavenger, pH modifier, viscosity modifier, pour point additive and any combination thereof.

In view of the above, the present invention provides a fluid blend with the property of whatever compressor operating temperature is selected (above 400, etc.), the inventive fluid of equal ISO Viscosity Grade has a higher diluted viscosity. If the matches are undiluted, then the inventive fluids have a higher viscosity when diluted. This provides better sealing and lubricity.

Throughout this application, various publications, including United States patents, are referenced by author and year and patents by number. Full citations for the publications are listed below. The disclosures of these publications and patents in their entireties are hereby incorporated by reference into this application in order to more fully describe the state of the art to which this invention pertains.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. A composition of compressor working fluid comprising: a dissolved gas or a condensate from a dissolved gas in a dilution amount at least 5% by weight; and a base fluid including at least a first base stock and a second base stock, wherein the viscosity difference between said first base stock and said second base stock is greater than 125 cSt, Kv 100° C.; wherein said base fluid is chosen from the group consisting of said first base stock being a synthetic polyalphaolefin (PAO) with a viscosity less than 10 cSt and greater than 2 cSt, Kv 100° C. with said second base stock being a synthetic polyalphaolefin with a viscosity greater than 135 cSt, Kv 100° C., said first base stock being a polyglycol or polyalkylene glycol with a viscosity less than 15 cSt and greater than 2 cSt, Kv 100° C. and said second base stock being a polyglycol or polyalkylene glycol with a viscosity greater than 135 cSt, Kv 100° C., and said first and second based stocks being comprised of two polyol esters.

2. The composition of claim 1, wherein said first base stock is a synthetic polyalphaolefin (PAO) with a viscosity less than 10 cSt and greater than 2 cSt, Kv 100° C., and said second base stock is a synthetic polyalphaolefin with a viscosity greater than 295 cSt, Kv 100° C.

3. The composition of claim 1, wherein at said first base stock is a synthetic polyalphaolefin with a viscosity less than 10 cSt and greater than 2 cSt, Kv 100° C., and said second base stock is a synthetic polyalphaolefin with a viscosity greater than 900 cSt, Kv 100° C.

4. The composition of claim 1, further comprising at least one additive chosen from the group consisting of antiwear, antioxidant, defoamant, demulsifier, detergent, dispersant, metal passivator, friction reducer, rust inhibitor, acid scavenger, free radical scavenger, pH modifier, viscosity modifier, pour point additive, and combinations thereof.

5. The composition of claim 1, further comprising a third base stock.

6. The composition of claim 5, wherein said third base stock is chosen from a group consisting of a PAO with a viscosity of at least 4 cSt, Kv 100° C. and no more than 100 cSt, Kv 100° C., ester base stock, alkylated aromatic, and combinations thereof.

7. The composition of claim 5, further comprising a fourth base stock, and where any combination of two or more of said base stocks results in a first blended base stock and a second blended base stock with the viscosity difference between said first blended base stock and said second blended base stock is greater than 135 cSt, Kv 100° C.

8. The composition of claim 1 , wherein said two esters are selected from the group including polyol esters and complex polyol esters.

9. The composition of claim 1, wherein the viscosity index is greater than 200.

10. The composition of claim 1, wherein the difference in number average molecular weight between said first and said second base stocks is greater than 2900.

11. The composition of claim 1, wherein the difference in number average molecular weight between said first and said second base stocks is greater than 3900.

12. The composition of claim 2, wherein the difference in number average molecular weight between said first and said second base stocks is greater than 2900.

13. The composition of claim 2, wherein the difference in number average molecular weight between said first and said second base stocks is greater than 3900.

14. The composition of claim 1, wherein the difference in number average molecular weight between said first and said second base stocks is greater than 1400.

15. The composition of claim 1, wherein the difference in number average molecular weight between said first and said second base stocks is greater than 2300.

16. The composition of claim 1, wherein said dissolved gas is chosen from the group consisting of saturated and unsaturated hydrocarbons having 1 to 26 carbon atoms, halocarbons, hydrofluorocarbons, fluorocarbons, fluoroethers, fluorochlorohydrocarbons, methanol, combustion gases, nitrogen, chlorine, methyl chloride, vinyl chloride, ammonia, carbon monoxide, carbon dioxide, carbon monoxide, hydrogen, helium, air, water vapor, and combinations thereof.

17. A method of achieving favorable viscosity for a compressor working fluid, including the step of: combining a dissolved gas or a condensate from a dissolved gas in a dilution amount of at least 5% by weight with a base fluid including a first base stock and a second base stock, wherein the viscosity difference between the first and second base stock is greater than 125 cSt, Kv 100° C. wherein the base fluid is chosen from the group consisting of the first base stock being a synthetic polyalphaolefin (PAO) with a viscosity less than 10 cSt and greater than 2 cSt, Kv 100° C. with the second base stock being a synthetic polyalphaolefin with a viscosity greater than 135 cSt, Kv 100° C., the first base stock being a polyglycol or polyalkylene glycol with a viscosity less than 15 cSt and greater than 2 cSt, Kv 100° C. and the second base stock being a polyglycol or polyalkylene glycol with a viscosity greater than 135 cSt, Kv 100° C., and the first and second based stocks being comprised of two polyol esters.

18. The method of claim 17, further including the step of adding a third base stock.

19. The method of claim 18, further including the step of adding a fourth base stock.

20. The method of claim 17, further including the step of adding at least one additive chosen from the group consisting of antiwear, antioxidant, defoamant, demulsifier, detergent, dispersant, metal passivator, friction reducer, rust inhibitor, acid scavenger, free radical scavenger, pH modifier, viscosity modifier, pour point additive, and combinations thereof.

21. A method of reducing dilution from gas being compressed for a compressor working fluid, including the step of combining a dissolved gas or a condensate from a dissolved gas in a dilution amount of at least 5% by weight with a base fluid including a first base stock and a second base stock, wherein the viscosity difference between the first and second base stock is greater than 125 cSt, Kv 100° C., wherein the base fluid is chosen from the group consisting of the first base stock being a synthetic polyalphaolefin (PAO) with a viscosity less than 10 cSt and greater than 2 cSt, Kv 100° C. with the second base stock being a synthetic polyalphaolefin with a viscosity greater than 135 cSt, Kv 100° C., the first base stock being a polyglycol or polyalkylene glycol with a viscosity less than 15 cSt and greater than 2 cSt, Kv 100° C. and the second base stock being a polyglycol or polyalkylene glycol with a viscosity greater than 135 cSt, Kv 100° C., and the first and second based stocks being comprised of two polyol esters.

* * * * *